United States Patent [19]

Gilder

[11] Patent Number: 4,950,096

[45] Date of Patent: Aug. 21, 1990

[54] BINDING AND FILING UNIT

[75] Inventor: Herbert J. Gilder, Pittsfield, Mass.

[73] Assignee: Sheaffer Eaton Inc., Pittsfield, Mass.

[21] Appl. No.: 282,590

[22] Filed: Dec. 12, 1988

[51] Int. Cl.[5] ..... B42F 3/00

[52] U.S. Cl. ..... 402/4; 312/184; 402/7; 402/80 R

[58] Field of Search ..... 402/4, 5, 17, 65, 80 R; 281/43, 15.1, 21.1, 28, 45, 51, 49; 312/184, 183

[56] References Cited

U.S. PATENT DOCUMENTS

| | | | |
|---|---|---|---|
| 3,572,867 | 3/1971 | Cooper | 402/4 |
| 3,801,175 | 4/1974 | Giulie | 312/184 |
| 3,865,445 | 2/1975 | Dean et al. | 312/184 |
| 3,957,321 | 5/1976 | Rose | 402/17 |
| 4,009,784 | 3/1977 | Elias et al. | 312/184 |
| 4,114,963 | 9/1978 | Menahem | 402/5 |
| 4,208,146 | 6/1980 | Schudy | 402/80 R |
| 4,288,170 | 9/1981 | Barber | 281/43 |
| 4,395,058 | 7/1983 | Terrell | 312/184 |
| 4,487,520 | 12/1984 | Maier-Hunke et al. | 402/4 |

*Primary Examiner*—Douglas D. Watts
*Assistant Examiner*—Thomas Hamill, Jr.
*Attorney, Agent, or Firm*—Marshall, O'Toole, Gerstein, Murray & Bicknell

[57] ABSTRACT

A method for converting the usual report cover or binder into a unit which is conveniently and easily readied for storage in a suspension type filing system. The application discloses both a suspension element for use in putting the method into effect, and a combination unit including a binder in which two such suspension elements are slidingly mounted in the spine of the binder for selective manual movement relative to the spine between a retracted position within the spine and an extended position extending beyond the ends of the spine for engagement with spaced support rails of the type on which the binder will be placed for filing purposes.

21 Claims, 2 Drawing Sheets

BINDING AND FILING UNIT

FIELD OF THE INVENTION

This invention relates to a unit for use in binding and filing documents, and more particularly to a method for preparing and combining a pair of suspension elements with a report binder to provide a low cost space efficient combination unit adapted to accept and securely bind a sheaf of papers or like sheets and to be quickly and easily readied for storage in a suspension type file system.

BACKGROUND OF THE INVENTION

For many years, varius types of binders have been available commercially for use in binding a sheaf of papers or like sheets together as reports, as sample colelctions, as file groups, and for other like purposes. Likewise, for many years, file folders have been avilable with suspension elements which extend beyond the upper edges of the folders and on which the folders may be supported by a pair of spaced rails to permit their use in a suspension type filing system.

While there is a substantial area of overlap between binders and file folders in terms of their use, they are not interchangeable. Binders are not readily integrated into the usual suspension type file system, and instead are normally stacked or shelved separately. And file folders having fixed suspension elements generally are not circulated with their contents because of the danger that such elements will snag, scratch or damage other objects. Obviously, therefore, a combination unit capable of providing the features and advantages of both a binder and a suspension type file folder would be quite advantageous.

Hereinafter, for purposes of convenience the unmodified term "folders" will be understood to refer to file folders which have suspension elements, whether fixed or retractable, and which are intended for use in suspension type file system.

On a number of occasions in the past, others in the art have recognized the desirability of hybridizing binders and folders to provide binders suitable for use directly in suspension type file systems, thus eliminating the need for storing the binders separately or using separate folders for holding either the filled binders or the unbound material from the binders.

For example, U.S. Pat. No. 4,114,963 illustrates a folder adapted for use somewhat like a binder. This patent discloses a suspension folder having permanently but slidably mounted over the upper outer edge of each of its two leaves a channel or "U" shaped suspension element. These four elements normally are extended to support the folder in a suspension type file, but are retractable should the user wish to remove the folder from the file and use it as a cover for protecting its contents while they are in use in the course of normal office work.

Other patents suggest the opposite approach—that of adapting report binders for use in suspension type file systems. U.S. Pat. Nos. 3,572,867, 3,957, 321 and 4,487,520 are illustrative of one general type of structure involving this approach. This structure includes use of a pair of cover/flap units, with the flaps being pressed over the marginal edge of a sheaf of papers by a compression assembly including a compressor bar carrying two suspension hooks which are slidable on the bar between retracted and extended positions.

U.S. Pat. No. 4,288,170 discloses a similar structure, except that it proposes a double set of compressor bars and retractable extension members. And U.S. Pat. No. 3,865,445 discloses a complex suspension assembly including movable and fixed parts which permit use of the binder with various types of filing systems.

Other approaches to a combination unit are suggested in U.S. Pat. Nos. 3,801,175 and 4,208,146. In U.S. Pat. No. 3,801,175 a pair of retractable hanger units of substantial width are slidably mounted in groves at the edges of a relatively wide spine. In U.S. Pat. No. 4,208,146, a ring type notebook is adapted for suspension filing by an assembly which is loosely carried on the ring binders along with the papers and which provides a pair of relatively wide retractable hangers.

Although the above discussed prior art clearly indicates that the need for a hydridized binder/folder has long been recognized, none of the structures suggested to date are believed to have met with any significant commerical success. They have either been too costly to implement, too cumbersom or complex to assemble or use, or too consuming of available file space. For example, aside from any other disadvantages they might present, the thickness of the four channel members of U.S. Pat. No. 4,114,963, the large cumbersome suspension unit of U.S. Pat. No. 3,865,445 or the added thickness of the dual set of hangers of U.S. Pat. No. 3,957,321 would render these and similar structures unsuitable for use simply because of the space they would consume in a filing system.

SUMMARY OF THE INVENTION

The general object of the present invention is to provide a hybridized binder/folder unit which not only is low in cost, simple to produce, safe in use and conservative of file space but which is quickly easily and conveniently converted from use as a binder to use as a protective yet space efficient folder for the safe storage and easy retrieval of reports and other sheafs of papers and like sheets.

This general object is realized through the combination of a pair of unique suspension elements with any one of the several types of report covers or binders now used widely in school and industry, in which the following structural features or their equivalent are provided:

a spine having
- a pair of separable binding strips
- a central dold collinear with and disposed either between or proximate such binding strips, and at least two clamping members extending between and operatively engaging the binding strips at locations which are spaced transversely from the central fold and substantially equal-distant from the ends of the spine.

Such features are found in varius types of binders currently being produced and sold by several U.S. manufacturers including a line sold widely under the tradename DUO-TANG by Sheaffer Eaton Inc. of Pittsfield, Mass.

The suspension element used in this invention preferably is stamped from a flat sheet of relatively thin rigid material, such as a tough plastic, a stiff composition board or a suitable metal. The finished suspension element is of a generally elongage rectangular configuration of approximately the same height as that of the binding strips of the binder. The upper edge of surface of the suspension element preferably is straight and smooth although it will be understood that several smooth projections spaced therealong will function the same as a straight surface.

Spaced below and parallel to the upper surface of the suspension element is a relatively short intermediate surface, the ends of which terminate in transversely disposed end surfaces. In the preferred embodiment, the intermediate and end surfaces are provided by a slot which is of a width slightly greater than the height of the clamping members of the binder and of a length substantially equal to the distance the suspension elements travel in moving between their retracted and extended positions.

A notch opens through the lower surface of the suspension element adjacent one end thereof, such end hereinafter sometimes being called the "head portion."

After selecting a binder and preparing a pair of suspension elements having the structural features and characteristics described above, the unit of the present invention is completed as follows:

a first suspension element is placed in the spine of the binder proximate one end thereof, with the head of the suspension element being positioned outwardly of the spine, its upper surface in engagement with the center fold of the spine, and its slot engaged over the clamping member nearest that one end;

a second suspension element is placed in the spine of the binder proximate the other end thereof, with the head of the suspension element being positioned outwardly of the spine, its upper surface in engagement with the center fold of the spine, and its slot engaged over the clamping member nearest that other end;

the clamping members are fed through pre-punched holes in the marginal edge of the sheaf of sheets to be mounted in the binder and into operating engagement with the binding strips to clamp both the marginal edge and the suspension elements in the spine.

After the preceding steps have been completed, the binder may easily and readily be conditioned for placement in a suspension type file simply by moving the suspension elements longitudinally along the spine from a retracted position disposed substantially within the spine to an extended position wherein the heads of the suspension elements project beyond the spine to an extended position wherein the heads of the suspension elements project beyond the spine to expose the notches therein to receive a pair of support rails upon placement of the binder between the rails.

DETAILED DESCRIPTION

Figure 1:
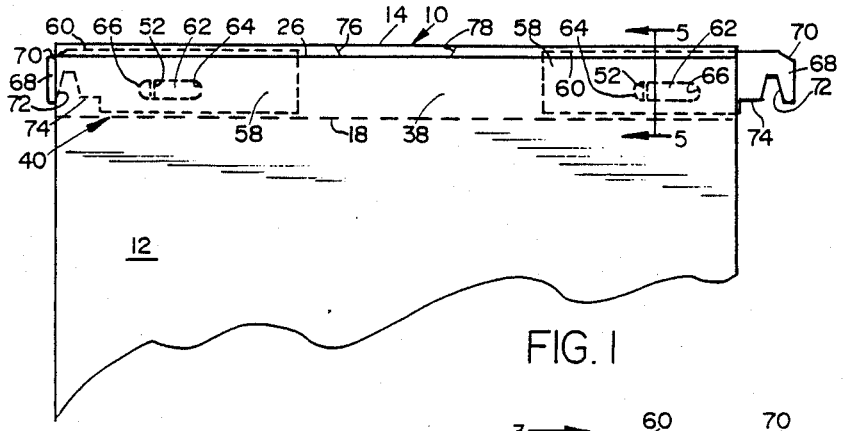
FIG. 1 is a front elevational view of one embodiment of the binder/folder unit of the present invention, showing one suspension element in its retracted position and the other suspension element in its extended position.

Referring now to the drawings and more particularly to FIG. 1, there is disclosed a binder/folder unit 10 including a binder 12 formed from a unitary rectangular cover sheet stamped from a tough flexible and attractively finished paper or plastic material of a type normally used for report covers and like products. As best seen from FIG. 5, the cover sheet is folded on a plurality of parallel crease lines which extend transversely across the width of the cover sheet and which are symmetrically arranged around a central crease line or fold 14.

As will be obvious to those in the art, the cover sheet is first folded in half along the central fold 14 to form two equally sized panels. Approximately one inch (1") from the central fold, each panel is then folded back on itself around crease lines 16 and 18 to form spine portions 20 and 22. Approximately three-fourths of an inch ($\frac{3}{4}$") from crease lines 16 and 18 the panels are agin folded back on themselves around crease lines 24 and 26 to form additional spine portions 28 and 30 and covers 32 and 34. As will be explained in more detail herebelow, spine portions 20 and 28 are permanently affixed together to form a fist binding strip 36, and portions 22 and 30 are permanently affixed together to form a second binding strip 38. The two binding strips then comprise spine 40.

As the crease lines used in folding the cover sheet are parallel and symmetrically arranged around the central fold, the binding strips are congruent, are of an elongage rectangular configuration and have collinear inner or upper edges which are hinged together along the central fold 14. Likewise, the covers 32 and 34 are congruent, and are hinged to binding strips 36 and 38 along crease lines 24 and 26.

The covers 32 and 34 are sized in width and height to extend a short distance beyond the edges of the paper or other material intended to be mounted in the binder 12.

Figure 4:
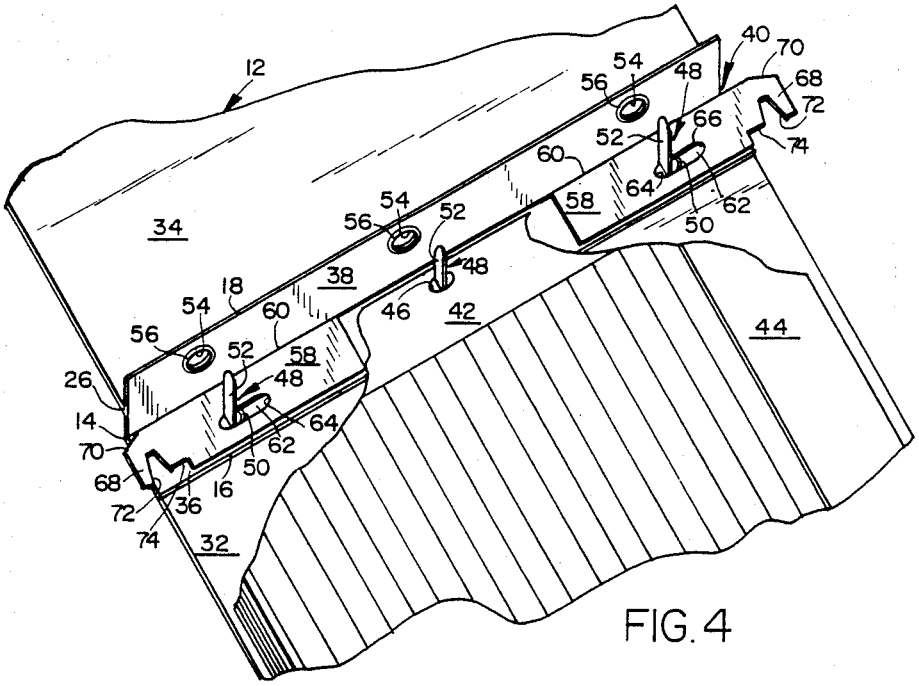
FIG. 4 is a partially cut away perspective view of the unit of FIG. 1, showing the covers opened and the binding strips separated.
Figure 5:
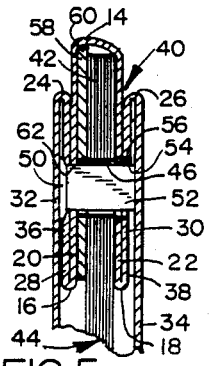
FIG. 5 is a partial cross-sectional enlarged view of the unit of FIG. 1, taken on the line 5—5 of FIG. 1.
Figure 6:
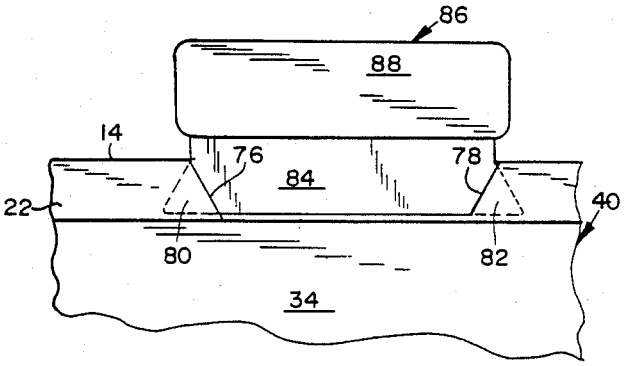
FIG. 6 is an enlarged front elevation view of a portion of the spine of the unit of FIG. 1, showing an index tab mounted in the set of angled slots.

As will be noted particularly from FIGS. 4 and 5, the binding strips 36 and 38 are separable from one another to receive therebetween the marginal edge 42 of a sheaf 44 of sheets of paper or other like material. Reports, collections of wallpaper samples, color and pattern swatches, and the like are a few examples of the types of materials which may be bound in the binder 12.

The marginal edge 42 is provided with a plurality of perforations 46 which are spaced and sized to receive clamping members 48. Normally, three clamping members 48 are provided in a binder of the type here involved, but two would be sufficient for purposes of this invention.

The clamping members include a rivet like mounting portion 50 permanently affixed to and permanently affixing spine portions 20 and 28 together as binding strip 36. Projecting perpendicularly from each mounting portion 50 is a relatively flat thin prong portion 52 which extends through perforation 46 in the sheaf 42 and aperture 54 in eyelet 56. The eyelets 56 are permanently affixed to and permanently affix spine portions 22 and 30 together as binding strip 38.

The prong portions 52 are ductile and are readily bent by the user into engagement with the outside surface of binding strip 38 to clamp the binding strips 36 and 38 together over the marginal edge 42 of the sheaf of sheets 44. Thus, the sheaf of sheets is securely held and protected within the binder 12 as it handled during use.

As indicated earlier in this specification, others in the art have attempted to provide binders which are also suitable for use as filing folders. As far as is known, however, none of these earlier proposals have proven successful because of cost, bulk, complexities and/or inconvenience associated with their use. In the present invention, all such disadvantages are eliminated and practical, low cost, simple and convenient binder/-folder unit is provided.

The foregoing advantages are realized by the use of a pair of unitary suspension elements 58 placed at opposite ends of the spine 40 of binder 12. The suspension elements are longitudinally slidable relative to the spine 40 between a retracted position as illustrated on the left in FIGS. 1 and 4 and an extended position as illustrated on the right in those figures.

Figure 3:
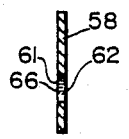
FIG. 3 is a cross sectional view of the suspension element as taken on the line 3—3 of FIG. 2.
Figure 2:
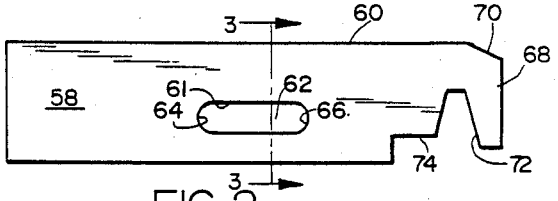
FIG. 2 is a front elevational view of a suspension element as included in the unit of FIG. 1.

As best seen from FIGS. 2 and 3 the suspension elements 58 are relatively thin and flat, and of a generally elongate rectangular configuration. Preferably, they are stampled from a flat sheet material, such as a strip of flat plastic, metal or composition material. Several criteria, should be kept in mind in selecting the material for use in fabricating the suspension elements 58. They should be free of sharp edges and burrs to avoid any possibility of injury to other materials or the user; they should be break resistant and tough to avoid breakage while extended; they should be relatively stiff in a transverse direction to assure the safe retention of a heavy binderf they should have a low coefficient of friction to assure easy sliding; they should be inert to environmental conditions to which they might be exposed during storage (i.e. moist air); and they should be light, inexpensive and easily produced, handled and stored. For this purpose, a flat sheet of inherently "slick" material such as polyproplene, nylon, or the like, is preferred. A thickness in the range of three-sixty fourth of an inch (3/64") has been found satisfactory.

The suspension elements are formed with a relatively straight elongate upper surface 60 and an intermediate surface 61 provided by a transversely offset parallel slot 62 located approximately mid point of the length of the upper surface 60. The slot 62 is offset from the upper surface 60 a distance which is approximately equal to the distance between the upepr edge of the prongs 52 and the center fold 14 of spine 40. In width, the slots whould be slightly wider than the height of the prongs 52. In length, the slots 62 should be equal to the distance which the suspension elements are to be moved relative to spine 40 between the retracted and extended positions illustrated in FIGS. 1 and 4, whereby the end surfaces 64 and 66 of slot 62 effectively act as stop means for limiting movement of the suspension elements between their extended and retracted positions.

The suspensions elements 58 include an outer head portion 68 which on its upper surface is tapered as at 70. Opening through the lower surface of head portion 68 is a notch 72 and a contiguous offset 74. The notch 72 and offset 74 are intended to receive and rest on a rod, bar or the like as may be provided as spaced support rails in the usual suspension type filing system.

Referring again to FIGS. 1 and 4, in preparing the binder 12 for use as a combination binder/folder unit, a pair of suspension elements 58 is positioned in the spine 40 of the binder 12 between the binding strips 36 and 38 after they have been opened or separated as illustrated in FIG. 4. In this position the prongs 52 are disengaged from apertures 54. One suspension element 58 is then positioned on binding strip 36 proximate each distal end of the spine 40, with its head portion 68 being disposed outwardly. The upper surface 60 of the suspension element 58 is placed in sliding engagement with the center fold 14 of the binder 12, and its slot 62 is positioned over and in sliding engagement with the prong 52 nearest that end of the spine. The marginal edge 42 of the sheaf of sheets 44 is then placed between the binding strips 36 and 38 against the suspension elements 58, with its perforations 46 over the prongs 52. The binding strip 38 is then rotated into engagement with the marginal edge 42 after the prongs 52 have been inserted through apertures 54. As a final step, that portion of the prongs 52 extending outwardly beyond eyelets 56 is bent over into engagement with the outside surface of the binding strip 38 to clamp the suspension elements 58 and marginal edge 42 securely within the spine 40.

Although the suspension elements are clamped or pressed between the marginal edge 42 and binding strip 36, the pressure involved is not sufficient to prevent sliding movement of the suspension elements between their retracted positions while the report binder is in normal use and circulation, and their extended positions exposing the head portions 68 whereby the notches 72 and offsets 74 are engageable with a pair of spaced support rails should the binder be placed therebetween for filing purposes.

It will be understood that while the suspension elements 58 are above described as being placed under the marginal edge 42 of the sheaf of sheets 44, the effect and function of the combination would be the same if the marginal edge 42 should be placed under the suspension elements. Thus, as a practical matter, the order in which the components are assembled makes no significant difference.

The upper surface of one side of the spine 40 is provided in spine portion 22 with at least one set of angled slots 76 and 78 which are spaced to receive the tips 80 and 82 of the mounting portion 84 of an index tab 86. The mounting portion preferably is formed of a relatively resilient plastic which is capable of being bowed sufficiently to permit insertion of the tips 80 and 82 into slots 76 and 78. The upper portion 88 may then be provided with a label or tag indicating the nature or subject matter of the material contained in the binder. Such an index tab, of course, will be readily visible after the suspension elements 58 have been extended and the binder placed in a suspension type file system.

Upon removal of the binder from the filing system at a later time, the index tab 86 can be removed conveniently merely by bowing the mounting portion 84 sufficiently to permit removal of the tips 80 and 82 from sltos 76 and 78. Further, it will be understood that it would be desirable to provide more than one set of angled slots 76 and 78 in spine 40 so that the user could select any one of several different positions for the index tab 86.

Figure 7:
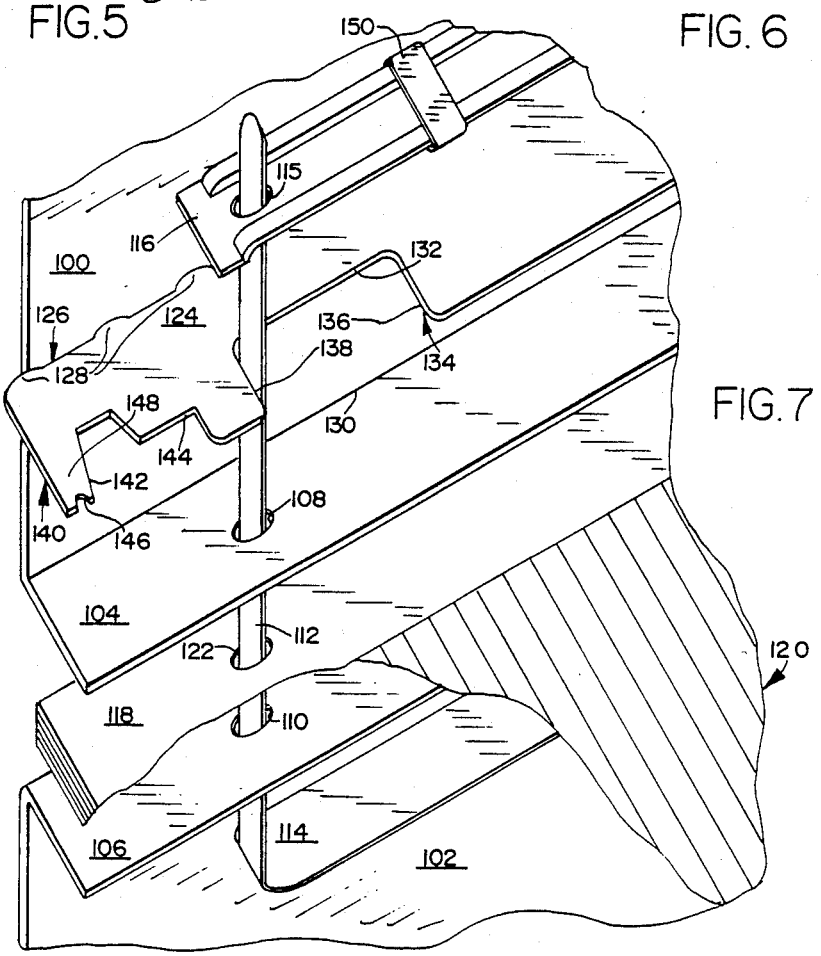
FIG. 7 is an exploded partially cut away perspective view of another embodiment of the binder/folder unit of the present invention.

Turning now to FIG. 7, there is disclosed a second embodiment of the present invention, wherein the binder is comprised of separate components including two assemblies of generally congruent covers 100 and 102 hingedly attached to congruent flap members 104 and 106.

The flap members 104 and 106 are provided with aperatures 108 and 110, sized and positioned to receive an elongatge prong 112 which extends perpendicularly from binding strip 114 through aperatures 110 and 108 and an aperture 115 in a second binding strip 116.

The marginal edge 118 of a sheaf of sheets 120 is placed between flaps 104 and 106. Perforation 122 in marginal edge 118 is axially aligned with apertures 110, 108 and 115 of the flaps 106 and 104 and binding strip 116. The prong 112 thus extends through all components comprising the spine of the binder.

It will be understood, of course, that while FIG. 7 illustrates only one side of a binder, a second side would be required in order to provide a fully functional binder. As the second side is simply a mirror image of the first side, however, a detailed description and illustration thereof is not believed necessary for a full understanding of the present embodiment.

A pair of suspension elements 124 (only one of which is shown), is disposed between binding strip 116 and flap 104. As with the first embodiment, the suspension element is a relatively elongate generally rectangular unitary component formed of a thin rigid flat sheet material, preferably of a polyproplene or like plastic material.

The upper surface 126 of suspension element 124 defines a number of smooth upwardly raised dimples or projections 128 which are disposed in sliding engagement with the generally centrally disposed fold 130 of the cover/flap assembly 100-104.

An intermediate surface 132 is provided by a generally rectangularly shaped notch or recess 134 which opens through the lower surface of suspension element 124. End surfaces 136 and 138 of notch 134 are transversely offset from and contiguous with intermediate surface 132. The intermediate surface 132 is in sliding engatement with the upper edge of prong 112, and end surfaces 136 and 138 are adapted to abut prong 112 and act as stop means for limiting longitudinal movement of suspension element 124 relative to the binding strips 114 and 116.

Suspension element 124 includes an outer head portion 140 which is substantially the same as the outer head portion 68 of the first embodiment, including a notch 142 and contiguous offset 144. The present embodiment does, however, provide the additional feature of a small indent 146 in the lower surface of the outer tip 148 of the head portion 140. This indent is provided as a means by which the user may pull the suspension element 124 outwardly from its retracted position by use of a thumb or finger nail.

In readying this embodiment for use, the two cover/-flap assemblies, the marginal edge 118 of the sheaf of paper 120, the binding strip 116 and suspension elements 124 are all assembled over the prong 112 of binding strip 114 as illustrated in FIG. 7. These various components are then pushed together with the upper cover 100 open to permit free movement of prong 112 through the various apertures until the binding strips 114 and 116 press flaps 106 and 104 over the marginal edge 118 of the sheaf 120, with the suspension elements 124 being slidably clamped between finding strip 116 and flap 104. The free end of prong 112 may then be bent over the edge of aperture 115 and into engagement with binding strip 116, whereafter slide 150 may be moved along the binding strip 116 to engage and hold the end of the prong 112 against inadvertent displacement.

After assembly of the binder with the sheaf of sheets 120 and the necessary suspension elements 124, the suspension elements normally are placed in a retracted position with transverse end surfaces 138 in abutment with prongs 112, while the binder is in use and circulation. After it has served its immediate purpose, the binder may be conditioned for filing quickly and simply, merely by inserting a thumb or finger nail in indents 146 and pulling the suspension elements 124 outwardly of the spine of the binder until transverse surfaces 136 abut prongs 112 and notches 142 and offsets 144 are exposed for engagement with a pair of spaced support rails upon filing of the binder in a suspension type filing system.

The above description of embodiments of this invention is intended to be illustrative only and not limiting. Other embodiments of this invention will be obvious to those skilled in the art in view of the preceding disclosure.

Having thus described preferred embodiments of the invention, what is claimed to be new and novel and desired to be protected by Letters Patent is as follows.

I claim:

1. In a unit for binding and filing a sheaf of sheets, the combination of (A) a binder having a spine comprised of a central fold and a pair of binding strips separable from one another to receive a marginal edge of said sheaf therebetween, (B) at least two clamping members extending through perforations in said marginal edge and operatively engaging said binding strips to clamp said marginal edge within said spine, (C) a pair of unitary generally flat suspension elements slidingly disposed within said spine proximate the distal ends thereof, each of said suspension elements comprising (1) first support means slidingly engaging said central fold, (2) second support means slidingly engaging one of said clamping members, (3) stop means for limiting movement of said suspension element between retracted and extended positions relative to the proximate distal end of said spine, and (4) a head portion (a) disposed substantially within said spine upon movement of said suspension element to its retracted position and (b) projecting beyond the proximate end of said spine upon movement of said suspension element to its extended position, (D) said binder being suspendable between a pair of spaced support rails upon movement of both said suspension elements to their extended positions to project said head portions beyond opposite distal ends of said spine for engagement with said spaced rails.

2. A unit according to claim 1, wherein (A) said suspension elements are comprised of a relatively thin rigis sheet material, (B) said first support means comprises an upper surface disposed in sliding engagement with said central fold, and (C) said second support means comprises an intermediate surface disposed parallel to said upper surface and in sliding engagement with said one clamping member.

3. A unit according to claim 2, wherein (A) said intermediate surface is transversely spaced from said upper surface, and (B) said stop means comprises a transverse end surface disposed proximate each end of said intermediate surface for abutting engagement with said one clamping member.

4. A unit according to claim 3, wherein said intermediate surface and said end surfaces are contiguous and defined by a slot (A) located in said suspension element intermediate the ends of and transversely offset from said upper surface, and (B) sized to removably receive and slidingly engage said one clamping member to permit relative sliding movement between said slot and said one clamping member as said suspension element is moved between its retracted and extended positions.

5. A unit according to claim 4, wherein each said suspension element is generally rectangular and of a height substantially equal to the height of said spine, and includes (A) a notch opening through the lower surface of said head portion, (B) said notches engaging said spaced support rails upon movement of said suspension elements to their extended positions and suspension of said binder between said rails.

6. A unit according to any of the preceding claims 1 through 5, wherein (A) said binding strips (1) extend substantially the full width of said folder, (2) are of a generally congruent rectangular confiuration, (3) have collinear inner edges hinged together along and movable around said central fold upon separation of said binding strips for the reception of said marginal edge therebetween, (B) said suspension elements are disposed between said binding strips, (C) said clamping members are affixed to one of said binding strips and project through apertures in said other binding strip, and (D) a pair of cover sections are rotatably attached to said binding strips, said cover sections being generally congruent and rotatable relative to said strips to a position covering such sheaf of sheets as may be carried within said binder.

7. A unit according to claim 6, wherein said spine is provided with at least one set of longitudinally spaced slits, and an index tab having a mounting portion comprising a pair of resiliently displaceable legs insertable into said slits to mount said index tab on said folder.

8. A unit according to claim 6, wherein (A) said binder comprises a unitary cover sheet, and (B) said clamping members comprise unitary fastening devices having (1) mounting portions riveted to one of said binding strips and (2) ductile prong portions (a) extending from said mounting portions transversely through apertures in said other binding strip and (b) being deformable into engagement with the exterior of said other binding strip to bias said binding strips toward each other and clamp therebetween the marginal edge of such sheaf of sheets as may be carried within said binder.

9. In a unit for holding and filing a sheaf of sheets, the combination of (A) a binder comprising a unitary cover sheet folded on a plurality of symmetrically spaced centrally disposed crease lines extending transversely across the width of said cover sheet to provide a spine comprised of (1) a central fold (2) a pair of generally congruent rectangular binding strips having collinear upper edges hinged together along and movable around said central fold to permit separation of said binding strips for the reception of a marginal edge of said sheaf therebetween, (3) generally congruent front and back cover sections, hinged to said binding strips for rotation relative to said spine between open and closed positions respectively exposing and covering such sheaf of sheets as may be carried by said binder, (B) at least two clamping members extending through perforations in said marginal edge for operative engagement with said binding strips, each said clamping member comprising a unitary fastening device having (1) a mounting portion riveted to one of said binding strips and (2) a ductile prong portion extending from said mounting portion transversely trhough an aperture in said other binding strip, said prong portion being deformable into engagement with the exterior of said other binding strip to bias said binding strips toward each other and clamp said marginal edge therebetween, (C) a pair of elongatge generally flat, generally rectangular unitary suspension elements slidingly disposed between said binding strips proximate the distal ends of said spine, each of said suspension elements being comprised of a generally flat relatively thin rigid plastic sheet material and provided with (1) an elongage straight upper surface slidingly engaging said central fold, (2) an elongate slot disposed parallel to and transversely offset from said upper surface, said slot being sized to receive one of said clamping members and defining (a) an intermediate surface disposed substantially mid-point of the ends of said upper surface and in sliding engagement with said one clamping member, and (b) means for limiting movement of said suspension element between retracted and extended positions relative to the proximate distal end of said spine, said limiting means comprising a transverse end surface disposed at each end of said intermediate surface of abutting engagement with said one clamping member, and (3) a head portion (a) disposed substantially within said spine when said suspension element is moved to its retracted position and (b) projecting beyond the proximate end of said spine when said suspension element is moved to its extended position, and (c) having a notch opening through the lower surface of said head portion, (D) said binder being suspendable between a pair of spaced support rails upon movement of both said suspension elements to their extended positions and projection of said head portions beyond opposite distal ends of said spine to expose said notches for engagement with said spaced rails.

10. A method for preparing a binder for use in a suspension type vertical filing sytem wherein the binder includes a spine having a central fold and a pair of binding strips between which the marginal edge of a sheaf of sheets is clamped by at elast two clamping members extending through perforations in said marginal edge into operative engagement with said binding strips, said method comprising the steps of (A) preparing two generally flat relatively thin rigid suspension elements and providing each such suspension element with an elongage upper surface and an intermediate surface positioned in a transversely spaced parallel relation with said upper surface, (B) placing one of said suspension elements in said spine collineary along said binding strips proximate one distal end thereof with its said upper surface in sliding engagement with said central fold and its said intermediate surface in sliding engagement with the clamping member nearest said one distal end, (C) placing the other of said suspension elements in said spine collinearly along said binding strips proximate the other distal end thereof with its said upper surface in sliding engagement with said central fold and its said intermediate surface in sliding engagement with the clamping member nearest said other distal end, (C) actuating said binding members to clamp said marginal edge between and said suspension elements relative to said binding strips, (E) selectively moving said suspension elements longitudinally relative to said binding strips between (1) a retracted position wherein said suspension elements are disposed substantially within said binding strips and (2) an extended position wherein said suspension elements project beyond said binding strips for engagement with a pair of spaced support rails upon placement of said binder between said rails.

11. The method of claim 10, comprising with each of said suspension elements the further steps of (A) providing a transverse end surface promixate each end of said intermediate surface and (B) positioning said transverse surfaces for abutment with said clamping member upon movement of said suspension element to its retracted and extended positions.

12. The method of claim 11, comprising with each of said suspension elements the further steps of (A) placing said suspension elements between said binding strips, (B) providing said intermediate surface and said transverse end surfaces as a slot in said suspension element and (C) positioning said slot to remobably receive and slidingly engage said clamping member.

13. The method of claim 12, comprising with each of said suspension elements the further step of forming a notch opening through the lower surface of that portion of the suspension element which projects beyond the binding strips when said suspension element is disposed in its extended position.

14. A pair of flat suspension elements (being comprised of) a generally flat relatively thin rigid sheet material, (A) each such suspension element being provided with upper and intermediate parallel surfaces, (B) one of the suspension elements being disposed collinerly with said binding strips proximate one distal end thereof, with its upper surface in sliding engagement with said central fold and said inermediate surface in sliding engagement with the clamping member nearest said one distal end, (C) the other the suspension element being disposed collinearly with said binding strips proximate the other distal end thereof with its upper surface in sliding engagement with said central fold and said intermediate surface in sliding engagement with the clamping member nearest said other distal end, (D) the suspension elements being longitudinally slidable relative to said binding strips between (1) a retracted position wherein said suspension elements are disposed substantially within said binding strips and (2) an extended position wherein the suspension elements project beyond said binding strips for engagement with a pair of spaced support rails upon placement of said binder between said rails.

15. A pair of suspension elements according to claim 14, wherein said suspension elements are disposed between said binding strips, with each such suspension element being provided with a transverse surface positioned proximate each end of said intermediate surface for abutting engagement with the proximate clamping member to limit longitudinal movement of said suspension element to its said retracted and extended positions.

16. A pair of suspension elements according to claim 15, wherein each of said suspension elements is provided with (A) a slot disposed transversely of said upper surface and defining said intermediate surface and said transverse end surfaces, said slot removably receiving and slidingly engaging said proximate clamping member, and (B) a notch opening through the lower surface of that portion of the suspension element which projects beyond said binding strips upon movement of said suspension element to its extended position, (C) said notches receiving and releasably engaging said spaced support rails upon placement of said binder between said rails with said suspension elements extended.

17. A combination binder and file folder comprising a cover element having a flap pivotally connected to an adjacent binding strip at one edge of the flap, said binder having a central fold disposed adjacent said cover element; said binding strip including a perforation adapted to receive a sheet retainer completely therethrough; a generally flat suspension element disposed adjacent said binding strip and having an uppper surface adapted for sliding engagement with said central fold, and having a longitudional slot therein adapted to receive said sheet retainer and for sliding engagement with said sheet retainer, said slot being transversely offset from said upper surface a distance which is approximately equal to a distance between an upper surface of the sheet retainer and said central fold.

18. The binder, file folder of claim 17 including two separable binding strips wherein said central fold is disposed between said binding strips and said suspension element is disposed between said binding strips.

19. The binder, file folder of claim 18 including two cover elements each pivotally connected to one of said binding strips.

20. A generally flat suspension element for use with a combination binder and file folder having a binding strip adjacent to and pivotally connected to one edge of a cover, said binding strip indlucing a perforation adapted to receive a sheet retainer therethrough, said sheet retainer extending through a perforation in sheet material, to be disposed within said binder and file folder, and through the perforation in the binding strip to bind the sheet material to the binding strip; said generally flat suspension element including a longitudional slot for alignment with said binding strip perforation and said sheet retainer and for receiving said sheet retainer, an upper edge of said suspension element cooperation with the pivotal connection between the cover and the binding strip, and said slot cooperating with said sheet retainer to allow longitudional sliding movement of said sheet retainer to allow longitudional sliding movement of said suspension element between retracted and extended positions, said suspension element being capable of engaging a support rail when in the extended position.

21. A generally flat suspension element for use with a combination binder and file folder haivng a central fold and a binding strip adjacent to and pivotally connected to one edge of a cover, said binding strip including a perforation adapted to receive a sheet retainer therethrough, said sheet retainer extending through a perforation in shee material to be disposed within said binder and file folder and through the perforation in the binding strip to bind the sheet material to the binding strip; said generally flat suspension element including a longitudional slot for alignment with said binding strip perforation and with said sheet retainer and for receiving said sheet retainer, an upper edge of said suspension element cooperating with the pivotal connection between the cover and the binding strip, and said slot cooperating with said sheet retainer to allow longitudional sliding movement of said suspension element between retracted and extended positions, said suspension element being capable of engaging a support rail when in the extended position.

* * * * *